US005368431A

United States Patent [19]

Willey et al.

[11] Patent Number: 5,368,431

[45] Date of Patent: Nov. 29, 1994

[54] TRASH BAG OPENER AND REMOVER

[76] Inventors: Edward B. Willey, 9248 Craig, Overland Park, Kans. 66212; J. Wayne Willey, deceased, late of 1510 Cedar, Belton, Mo. 64012; by Jack H. Willey, executor

[21] Appl. No.: 38,718

[22] Filed: Mar. 26, 1993

[51] Int. Cl.[5] ..... B65G 65/04

[52] U.S. Cl. ..... 414/412; 241/DIG. 38; 209/930

[58] Field of Search ..... 414/412; 241/23, 68, 241/DIG. 38; 209/930; 53/381.2, 384.1

[56] References Cited

U.S. PATENT DOCUMENTS

| | | | |
|---|---|---|---|
| 3,891,105 | 6/1975 | Cerroni | 414/412 |
| 3,948,402 | 4/1976 | Schott, Jr. | 414/412 |
| 4,034,877 | 7/1977 | Bennison | 414/412 |
| 4,098,463 | 7/1978 | Lowry | 241/23 X |
| 4,177,726 | 12/1979 | Kinard | 414/412 X |
| 4,207,021 | 6/1980 | Burdett, Jr. | 414/412 |
| 4,274,787 | 6/1981 | Mueller et al. | 414/412 |
| 4,278,383 | 7/1981 | Mueller et al. | 414/412 |
| 4,279,558 | 7/1981 | Lavoie | 414/412 |
| 4,390,135 | 6/1983 | Wakamatsu et al. | 414/411 X |
| 4,479,581 | 10/1984 | Kelyman, Jr. | 241/DIG. 38 X |
| 4,489,896 | 12/1984 | Cerroni | 241/DIG. 38 X |
| 4,515,509 | 5/1985 | Frisz | 414/412 |
| 4,798,508 | 1/1989 | Lewis | 414/412 |
| 4,930,968 | 6/1990 | Borglund | 414/412 |
| 4,995,770 | 2/1991 | Crane | 414/412 |
| 4,995,771 | 2/1991 | Sedgeley | 414/412 |
| 5,002,451 | 3/1991 | Hale et al. | 414/412 |
| 5,007,787 | 4/1991 | Schnader | 414/412 |
| 5,069,594 | 12/1991 | Bott et al. | 414/412 |
| 5,163,627 | 11/1992 | Bouche | 414/412 X |
| 5,188,500 | 2/1993 | Eide et al. | 414/412 |
| 5,232,168 | 8/1993 | Lybecker et al. | 241/DIG. 38 X |

FOREIGN PATENT DOCUMENTS

| | | | |
|---|---|---|---|
| 2028255 | 3/1980 | United Kingdom | 414/412 |

*Primary Examiner*—Michael S. Huppert
*Assistant Examiner*—James W. Keenan
*Attorney, Agent, or Firm*—Stinson, Mag & Fizzell

[57] ABSTRACT

A trash bag opener and removal apparatus has a feed conveyor, a housing assembly and a discharge conveyor for opening and removing plastic and paper bags filled with material and discharging the material at a chute end of the discharge conveyor. The bags are routed by the feed conveyor into the housing assembly, which has a separate input conveyor, a slicer assembly, a slitter assembly, a bag stripper assembly and first and second paddle wheels. The input conveyor is located proximate to the feed conveyor and travels faster than the feed conveyor to upset the bags and ensure that the bag bottoms are exposed for the slicer assembly. The slicer assembly has a rotating, cylindrical drum with three serrated blades along its length and oscillates to tear the bags open. The paddle wheels retard and assist in moving the bags and refuse from the slicer assembly to the slitter assembly, which has rotating notched disk blades to rip the bags open, and then to the discharge conveyor. The bags and refuse then pass beneath the bag stripper assembly, which has rotating, extending fingers that grab and remove the torn bags from the refuse. The fingers retract as the bag stripping assembly rotates and then drop the bags on top of the refuse. The discharge conveyor then moves the bags and refuse to the chute end for discharging the refuse.

11 Claims, 10 Drawing Sheets

TRASH BAG OPENER AND REMOVER

FIELD OF THE INVENTION

The present invention generally relates to the opening of plastic bags filled with waste materials and, more particularly, to an apparatus for opening and removing plastic and paper bags from the refuse previously contained in the bags.

BACKGROUND OF THE INVENTION

The filling of public landfills has become a topic of significant concern. Some communities have passed ordinances restricting the dumping of lawn refuse into landfills while others now restrict the dumping of plastic materials. While lawn waste and plastic refuse are only two of the materials of concern, these are among the most prominent. The present invention addresses the segregation of plastic and paper bags containing lawn refuse and separate handling of the yard waste and the plastic and paper bags, allowing the bags to be recycled.

It is considered to be desirable to have an apparatus which will automatically open and remove the bag from the material, such as lawn waste, which the bag previously contained. Prior devices and apparatuses have been developed in an attempt to meet this objective. These prior devices and apparatuses have generally included a holding chamber for the yard waste and the use of an auger which mangled the bag and was intended to separate the trash from the bag.

The present invention is an apparatus for opening and removing bags from material that are loaded on a conveyor which then feeds the bags and material into a housing assembly. The housing assembly has slicing and slitting assemblies for cutting open the bags filled with material. Paddle wheel assemblies are used to press the bags and material against the slicing and slitting assemblies and retard and assist in moving the bags and material to the discharge conveyor. The slitting assembly has notched disks that slit the bags which allow a bag stripping assembly to remove the bags from the material. The bag stripping assembly places the removed bags on top of the material as a discharge conveyor carries the material out of the enclosed housing assembly. An operator then easily removes the bags while the material is carried by the discharge conveyor to a discharge end for loading onto a dump vehicle.

SUMMARY OF THE INVENTION

The present invention is a bag opening and removing apparatus that includes a substantially enclosed housing that has a receiving end and a discharge end. The apparatus has a feed conveyor for feeding the receiving end with bags filled with material. The enclosed housing includes a slicing zone adjacent to the receiving end that has a rotating cylindrical drum with oscillating blades along its length for laterally slicing bags filled with material, a slitting zone adjacent to the slicing zone having rotating notched disk blades for slitting the bags longitudinally, and a bag stripping zone between the slitting zone and the discharge end. The stripping zone has extensible fingers for stripping the bags from the material and placing the bags on top of the material for removal. The receiving end of the enclosed housing has an input conveyor which drives the feed conveyor. The input conveyor travels faster than the feed conveyor and moves the bags and the material in a generally horizontal plane into the slicing zone. The enclosed housing has two paddle wheels for retarding and assisting in propelling and containing the bags and the material within the enclosed housing and aiding in the slicing and slitting actions. The paddle wheels have rotatable shafts substantially horizontal within the housing assembly that are connected to drive motors for rotation. The paddle wheels maintain pressure and contact with the varying material height.

As the material and bags proceed through the slicing and slitting zones, a discharge conveyor moves the material and bags to a bag stripping assembly. The bag stripping assembly has fingers extending radially out of a drum housing for removing the bags from the material. As the bag stripping assembly rotates, the fingers are retracted within the drum surface and release the bags so that they fall freely on top of the surface of the refuse material. The bag stripping assembly maintains pressure and contact with the varying material height. The discharge conveyor then carries the material and the loosely placed bags out of the housing assembly. An operator can then remove the bags from the material as the discharge conveyor continues to carry the refuse material to a chute end for loading onto a transport vehicle. The bag stripping assembly and the discharge conveyor each have rotatable, driving units.

OBJECTS OF THE INVENTION

Accordingly, it is an object of the present invention to provide an apparatus for automatically stripping bags from contained refuse material; to provide such an apparatus which includes a substantially enclosed housing assembly having a receiving end and a discharge end; to provide such an apparatus having an enclosed housing assembly having a slicing zone adjacent to the receiving end and having oscillating blades for cutting bags filled with material; to provide such an apparatus having an enclosed housing which includes a slitting zone proximate to a slicing zone having notched disk blades for ripping the bags; to provide such an apparatus for removing bags having a substantially enclosed housing assembly which includes a bag stripping assembly positioned between the slitting assembly and the discharge end and having extensible fingers for stripping the bags from the material and placing the bags on top of the material for removal thereof; to provide such an apparatus having a feed conveyor rotatably driven for feeding the receiving end with bags filled with material; to provide such an apparatus having a discharge conveyor that is rotatably driven for removing the bags and the material from the enclosed housing; to provide such an apparatus having a discharge conveyor connected to a frame allowing for removal of the bags from the material and dumping the material at a chute end into an awaiting transport vehicle; to provide such an apparatus having first and second paddle wheels for retarding and assisting in propelling and containing the bags and the material within the enclosed housing; to provide such an apparatus having first and second paddle wheels on shafts mounted for rotation about a substantially horizontal axis and which are rotatably driven; to provide such an apparatus having a first paddle wheel that retards and assists in moving the bags and the material from an input conveyor from the receiving end of the enclosed housing to a slicing zone; to provide such an apparatus having a second paddle wheel that retards and assists in moving the bags and the material from the slitting zone to the discharge conveyor and the bag stripping assembly; and to provide such an apparatus having a lower drive assembly which rotatably drives the feed conveyor, the input conveyor, the slitting assembly and the slicing assembly.

Other objects and advantages of the present invention will be apparent from the following description, the following drawings and the appended claims.

BRIEF DESCRIPTION OF THE DRAWINGS

FIG. 7 is a longitudinal sectional view of the housing assembly taken along lines 7—7 of FIG. 4.

DESCRIPTION OF THE PREFERRED EMBODIMENT

As required, a detailed embodiment of the present invention is disclosed herein. It is, however, to be understood that the disclosed embodiment is merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
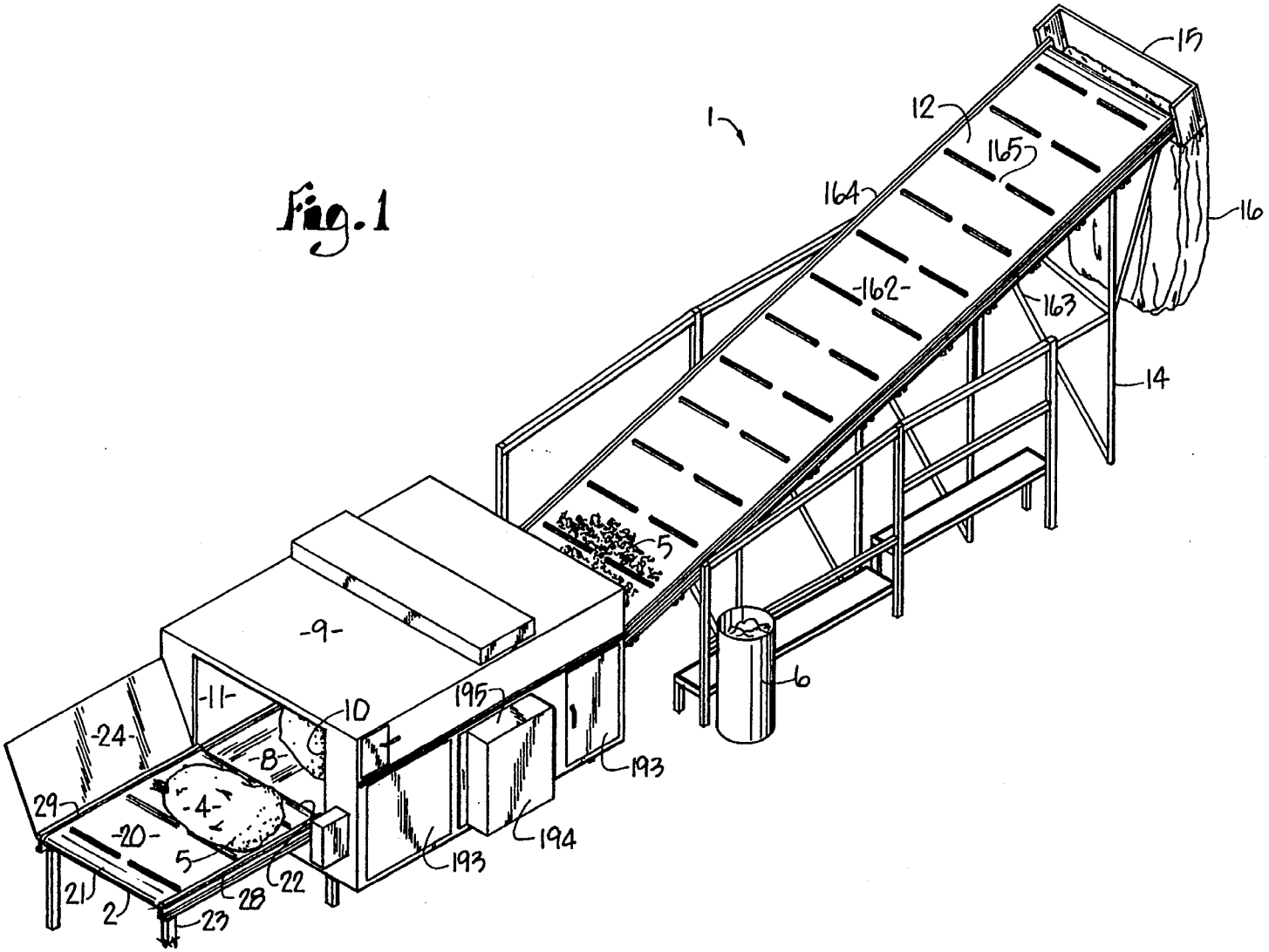
FIG. 1 is a perspective view of the plastic bag opener and removal apparatus.

As shown in FIG. 1, the apparatus 1 is disclosed having a feed conveyor 2 that routes plastic bags 4 filled with refuse material 5, such as yard waste, into an input conveyor 8 of a housing assembly 9. The housing assembly 9 has a first side 10 and a second side 11. The apparatus 1 also includes a discharge conveyor 12 which exits the housing assembly 9 and is positioned by a support frame 14. An operator (not shown) positioned adjacent the discharge conveyor 12 lifts the plastic bags 4 from the refuse material 5 and places the bags 4 in a recycling receptacle 6, as the material 5 is routed into a transport vehicle (not shown) through a chute end 15 and a drop guide 16.

Feed and Input Conveyors

Figure 2:
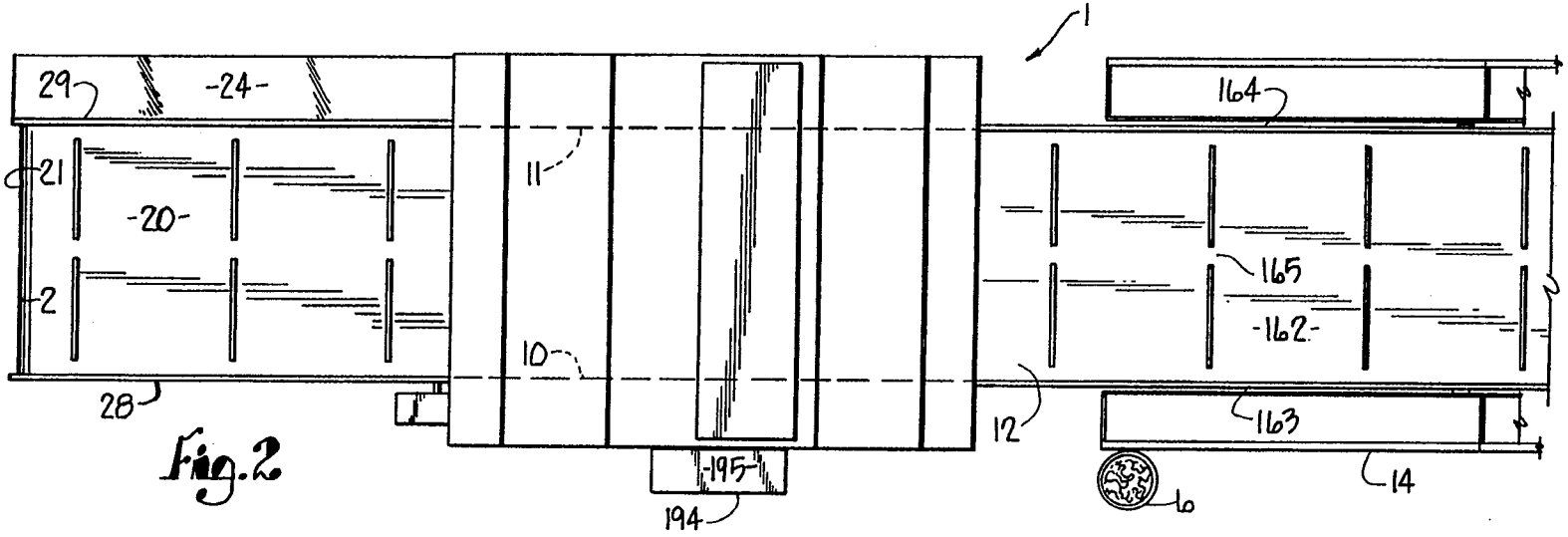
FIG. 2 is a plan view of the plastic bag opener and removable device.
Figure 3:
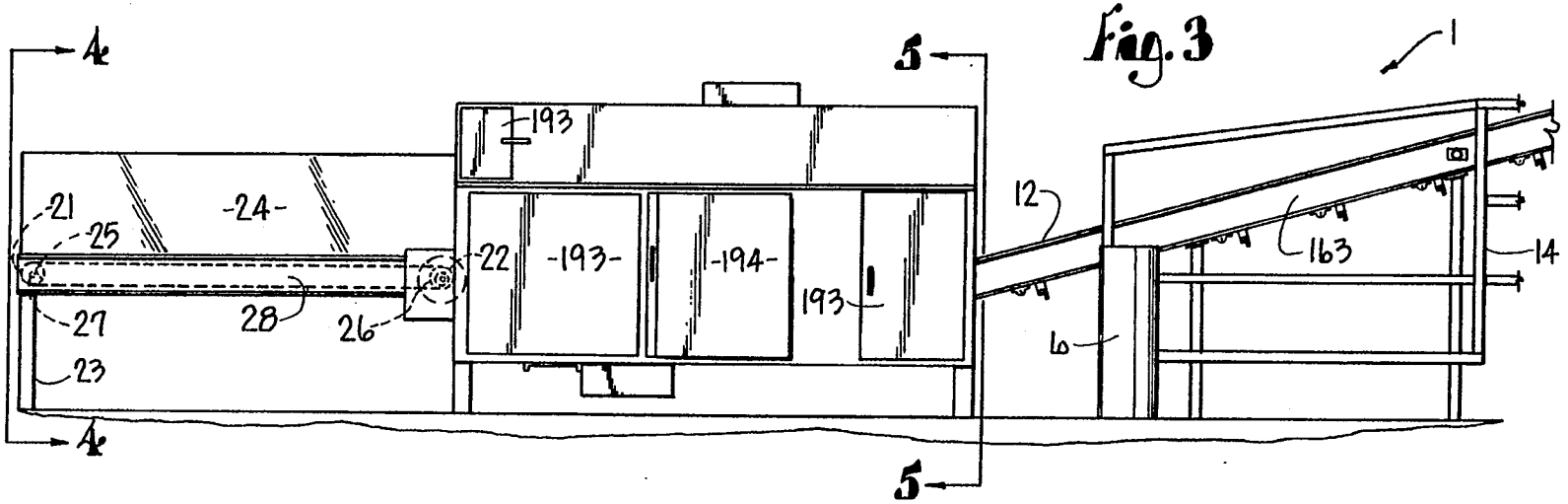
FIG. 3 is a side elevational view of the plastic bag opener and removal apparatus.
Figure 4:
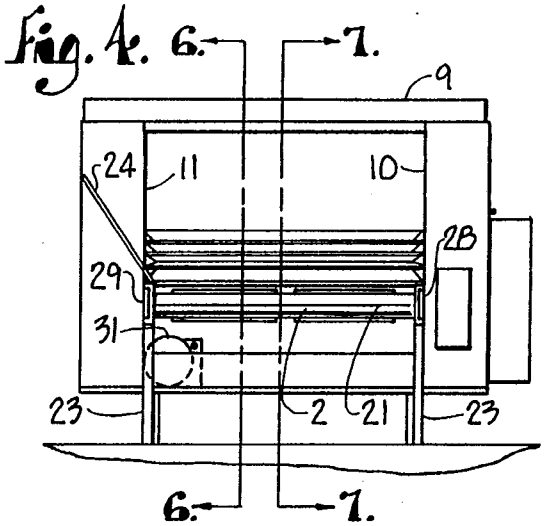
FIG. 4 is a front elevational view of the plastic bag opener and removal apparatus taken along lines 4—4 of FIG. 3.
Figure 5:
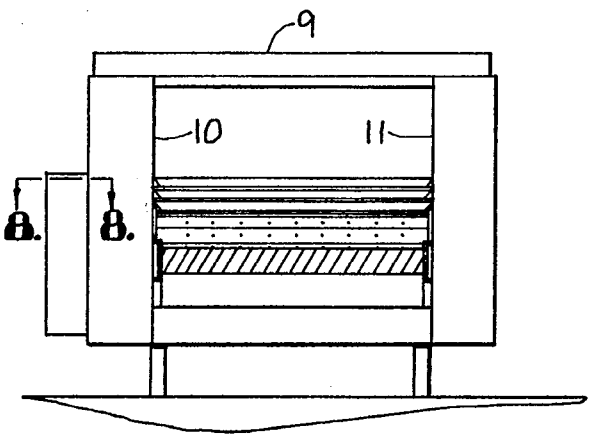
FIG. 5 is a cross sectional view of the plastic bag opener and removal apparatus taken along lines 5—5 of FIG. 3.
Figure 2A:
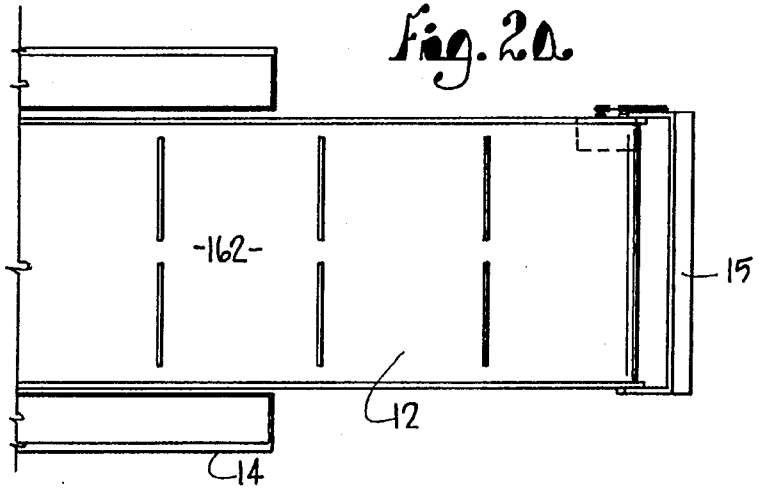
FIG. 2*a* is a plan view of a portion of the plastic bag opener and removal apparatus.
Figure 3A:
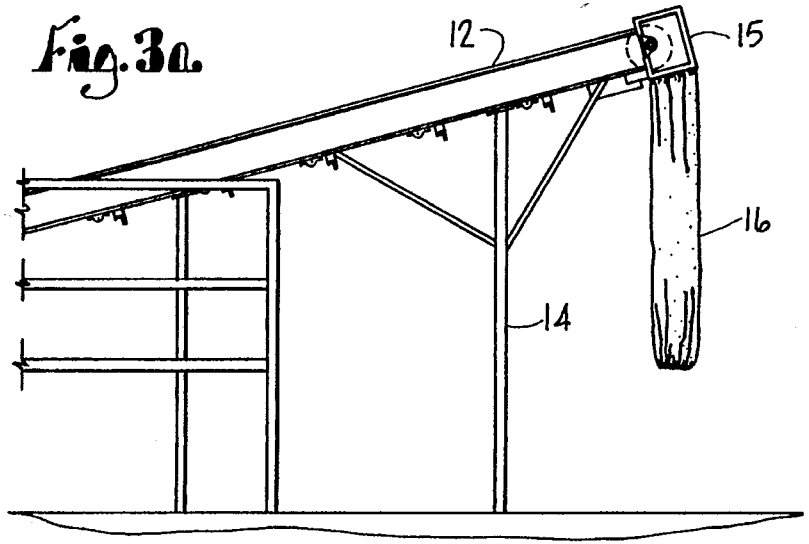
FIG. 3*a* is a side elevational view of a portion of the plastic bag opener and removal apparatus.

The feed conveyor 2, as shown in FIGS. 1, 2 and 3, has a cleated belt surface 20 and entry and exit ends 21 and 22. The feed conveyor 2 is supported by a frame 23 and has a ramp or feed guide 24 that extends from the second side 11 of the housing assembly 9 to the edge of the entry end 21 of the feed conveyor 2. The feed guide 24 assists the operator (not shown) in loading plastic bags on the feed conveyor 2.

Referring to FIGS. 3, 4, 6 and 7, the feed conveyor 2 has a take-up roller 25 mounted at the entry end 21 and a drive roller 26 mounted at the exit end 22. The take-up roller 25 has a shaft 27 that is rotatably journaled to the side walls 28 and 29 of frame 23. The drive roller 26 is powered by a lower drive assembly 31 mounted within the housing assembly 9 adjacent to the second side 11.

The lower drive assembly 31 includes a drive motor 32 connected to a gear reducer 33 which has a drive shaft 34 and a sheave 35 mounted on the drive shaft 34. The sheave 35 rotates as the drive shaft 34 turns. The sheave 35 is connected to a common drive shaft 38 which has a sheave 37 mounted to it and driven via belts 36. The common drive shaft 38 is rotatably journaled to the sides 10 and 11 of the housing assembly 9. The common drive shaft 38 has a sprocket 40 mounted on it proximate to the first side 10. The common drive shaft 38 rotatably drives the input conveyor 8. The common drive shaft 38 is connected to a drive shaft 41 of the input conveyor 8 proximate to the first side 10 via a sprocket 42 and a chain 43 extending around the sprockets 40 and 42. The input conveyor drive shaft 41 also has a second sprocket 44 mounted on it proximate to sprocket 42. The input conveyor 8 has a smooth conveyor belt surface 46, a take-up roller 47 and a drive roller 48. The take-up roller 47 is mounted on a shaft that is rotatably journaled to side walls 28 and 29, and is located beneath the feed conveyor 2 adjacent to its drive roller 26. The input conveyor drive shaft 41 is connected to the drive roller 26 of the feed conveyor 2 via sprockets 44 and 50 and a chain 51. The sprocket 50 is mounted on a drive shaft 49 of the drive roller 26 of the feed conveyor 2 next to the side wall 28.

Rotation of the drive shaft 41 of the input conveyor 8 turns the drive shaft 49 of the feed conveyor 2. In operation, FIG. 6, the lower drive assembly 31 rotates the drive shaft 34 in a clockwise direction which turns the common drive shaft 38. The common drive shaft 38 rotates in a clockwise direction which turns the input conveyor drive shaft 41 and the feed conveyor drive shaft 49. Through selection of the gearing ratios of the sprockets 44 and 50, the input conveyor 8 travels approximately four times faster than the feed conveyor 2, thereby causing the plastic bags 4 to upset and expose the bag bottoms for the slitter and slicer assemblies 55 and 65 mounted within the housing assembly 9.

Slitter Assembly

Figure 6:
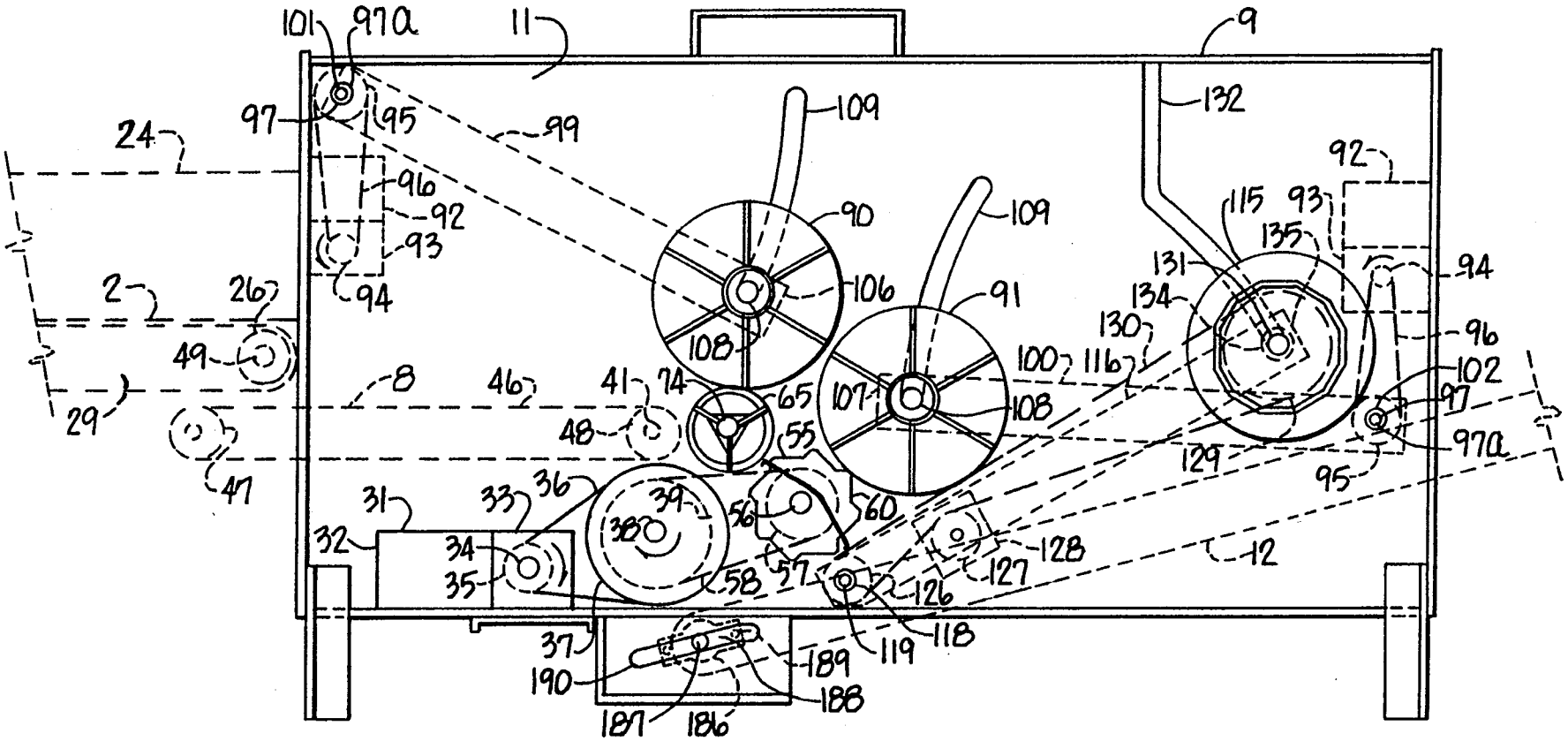
FIG. 6 is a longitudinal sectional view of the housing assembly taken along lines 6—6 of FIG. 4.
Figure 1:
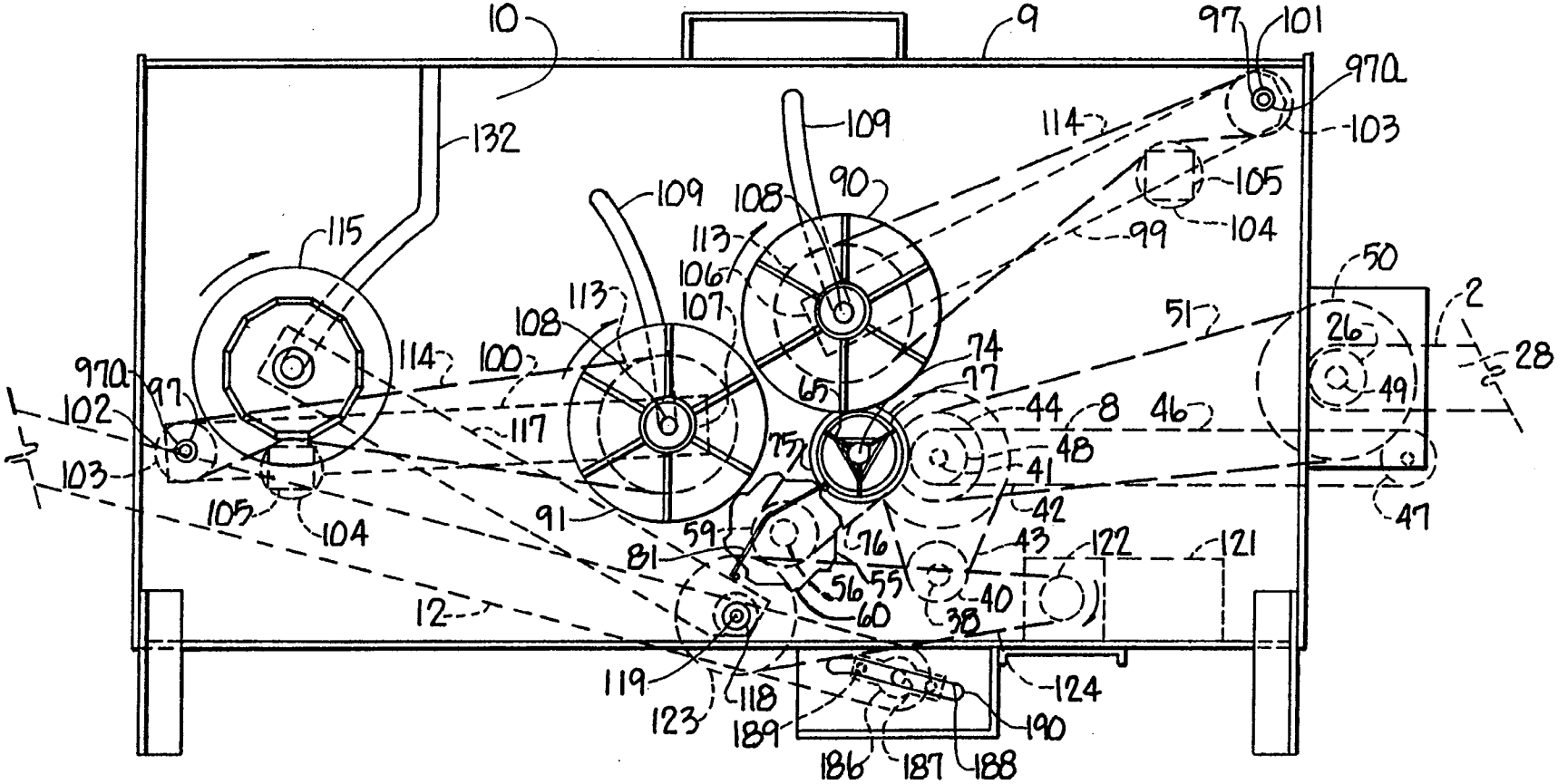

As shown in FIGS. 6 and 7, the slitter assembly 55 has a drive shaft 56 that is rotatably journaled through the sides 10 and 11. The drive shaft 56 has a sprocket 57 mounted on it next to the side 11 and driven by the lower drive assembly 31. The sprocket 57 is connected to the lower drive assembly 31 via a chain 58 extending around a sprocket 39 positioned adjacent to sheave 37 on a common drive shaft 38. As shown in FIG. 7, the drive shaft 56 also has a sprocket 59 mounted thereon proximate to the side 10.

Figure 16:
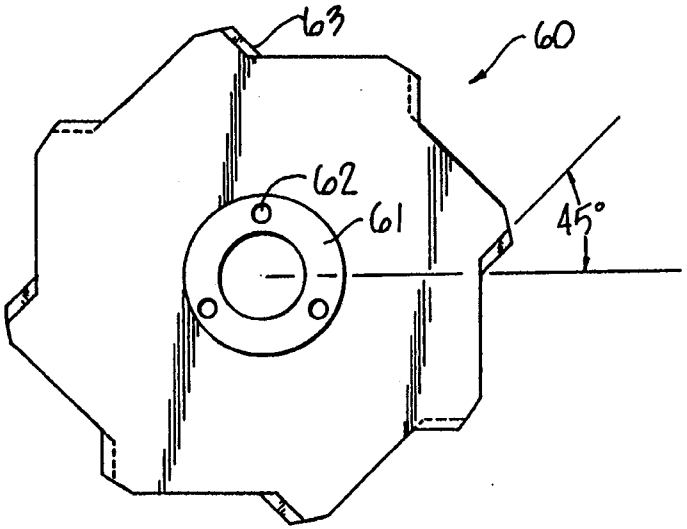
FIG. 16 is a side elevational view of a slitter disk.

As shown in FIGS. 6, 7, 16, 17 and 18, the slitter assembly 55 has slitter disks 60, such as nine in number, mounted on drive shaft 56, which are evenly spaced apart by spacers 61 also mounted on the drive shaft 56. The spacers 61 provide a spacing of approximately six inches between the disks 60. The disks 60, as shown in FIG. 16, are secured to the spacers 61 through dowel pins 62. The disks 60 have notched edges 63 that are 45° from the radius line extending from the center of the disk 60 and with each of the notch legs alternately sharpened to produce staggered cutting edges that reach a ¾" depth at the notch corner. The spacers 61 are secured to the shaft 56 by the set screws to contain the disks 60.

Figure 18:
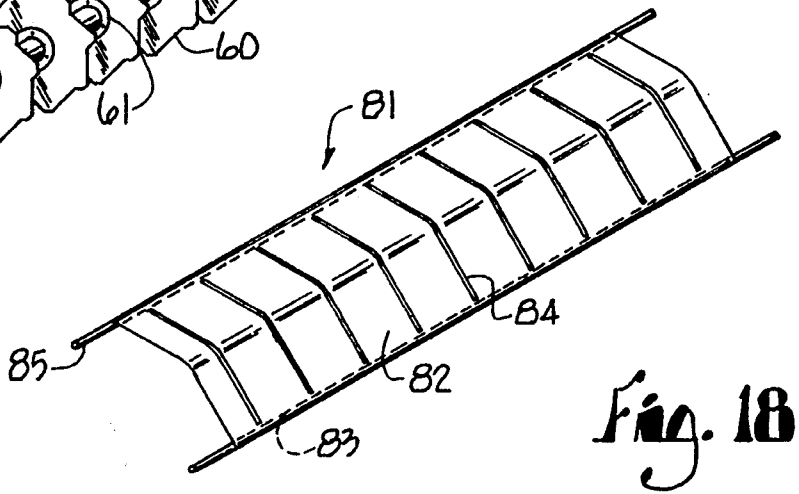
FIG. 18 is a perspective view of the strip plate of the slitter assembly.

As shown in FIGS. 6 and 7, the slitter assembly 55 is mounted approximately midway within the housing assembly 9 and positioned such that the bags 4 and the refuse material 5 are driven from the slicer assembly 65 down into the slitter assembly 55. As shown in FIGS. 6, 7 and 18, the slitter assembly 55 includes a strip plate 81 that has curved plates 82 with ends attached to tubes 83 which extend laterally between the first and second sides 10 and 11. The plates 82 are mounted between the disks 60 and form spacings 84 that allow for continuous rotation of the disks 60 therein. The tubes 82 receive rods 85 that continue through the first and second sides 10 and 11. The function of the strip plates 81 is to prevent the material 5 and the bags 4 from being wrapped around the slitter assembly 55 by the disks 60. The orientating of the strip plate 81 is to produce an unconfining obtuse angle between the disk notch 63 and the curved plates 82 which directs the refuse material 5 outwardly.

Slicer Assembly

Figure 8:
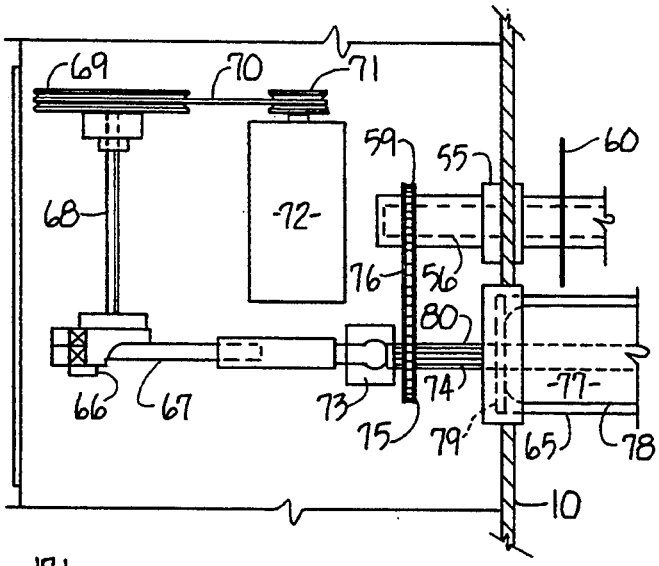
FIG. 8 is a sectional view of the oscillating assembly unit of the slicer assembly unit taken along lines 8—8 of FIG. 5.
Figure 20:
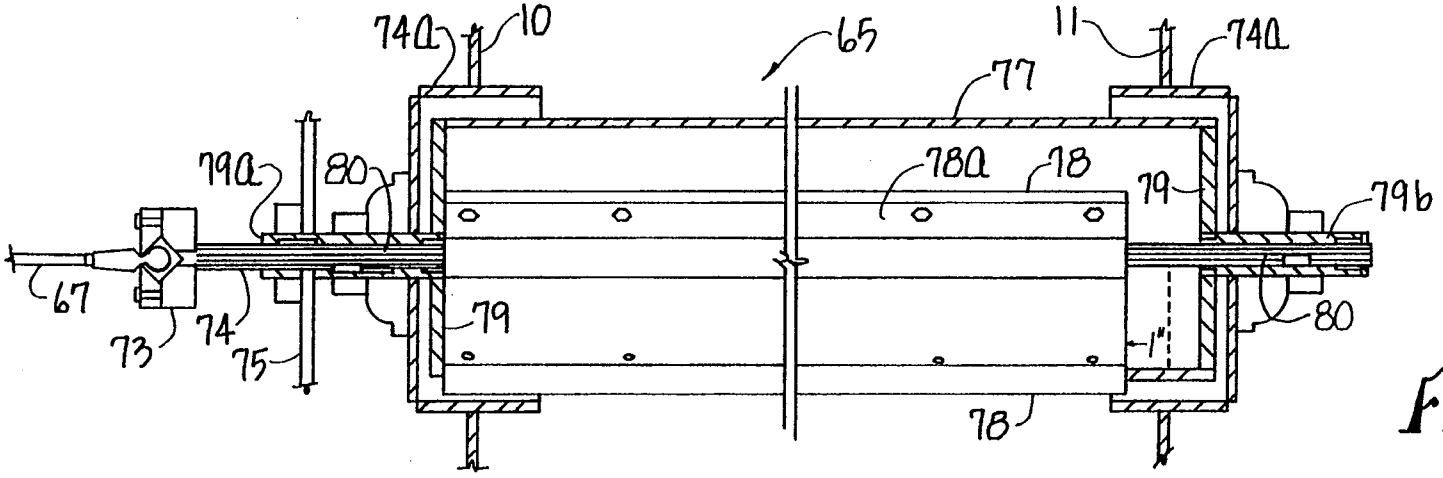
FIG. 20 is a longitudinal sectional view of the slicer assembly taken along lines 20—20 of FIG. 19.
Figure 19:
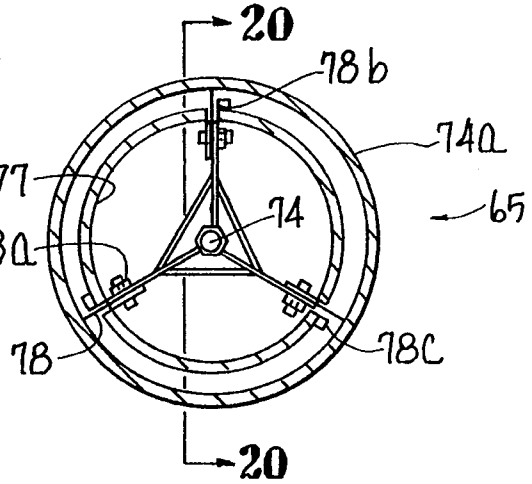
FIG. 19 is a cross sectional view of the slicer assembly taken along lines 19—19 of FIG. 12.

As shown in FIGS. 6 and 7, the slitter assembly 55 is connected to the slicer assembly 65, which is mounted in the housing assembly 9 directly above the slitter assembly 55 and adjacent to the input conveyor 8. Referring to FIGS. 5, 7, 8 and 12, the slicer assembly 65 includes an oscillating assembly 66 and a housing drum assembly 77. The oscillating assembly 66, FIG. 8, is mounted next to the first side 10. The oscillating assembly 66 has an oscillator 67, such as a Pitman arm oscillator, connected to a crankshaft assembly 68 with a sheave 69 mounted on it. The sheave 69 is rotated by belts 70 that are connected to a sheave 71 mounted on a shaft driven by a motor 72. The oscillator 67 is connected to a ball joint assembly 73 mounted on an oscillating shaft 74, which turns in a counterclockwise direction. The oscillating shaft 74, FIGS. 8 and 20, is externally splined. A ratchet sprocket 75 is mounted on a sleeve **79*a*, which is splined to the oscillating shaft 74, that connects the slicer assembly 65 to the slitter assembly 55 via a chain 76 driven by the sprocket 59 mounted on the drive shaft 56 of the slitter assembly 55. The housing cylindrical drum assembly 77 of the slicer assembly 65 has the oscillating shaft 74 mounted within it. The oscillating shaft 74 has three blades 78 that substantially extend the length of the housing drum assembly 77. The oscillating shaft 74 has a wedge clamp and release bar 78*a* to keep the blades 78 wedged and secured to the oscillating shaft 74 and within the housing drum assembly 77. The wedge clamp and release bar 78*a* can be adjusted to allow for easy blade replacement. As shown in FIGS. 8, 12, 19 and 20, the blades 78 extend radially out from the oscillating shaft 74 through slots 78*b* of the housing drum assembly 77, such that the blades 78 extend approximately ¾" out of the housing drum assembly 77 and approximately ⅛" past a retarder bar 78*c*. The housing drum assembly 77 has end plates 79 with internally splined sleeves that are rotatably journaled to sides 10 and 11 and receive the externally splined oscillating shaft 74. The end plates 79 journaled to side 10 has external notches that activate the drum assembly 77 when the ratchet sprocket 75 is turned by the chain 76 when drive shaft 56 of the slitter 55 is being rotated by the lower drive assembly 31. The ratchet sprocket 75 allows backward rotation of the drum assembly 77 for replacing the blades 78. The three blades 78 are positioned 120° apart along the oscillating shaft 74 and protrude through the housing drum assembly 77. The retarder bar 78*c* restrains the bags 4 from moving side to side as the blades 78** are oscillated.

The slicer assembly 65, FIG. 20, has sleeves **74*a* that are journaled through sides 10 and 11 and has the housing drum assembly 77 mounted within the sleeves 74*a*. The sleeves 74*a* are mounted over the sleeves 79*a* and 79*b*. The sleeves 74*a* extend over the end plates 79 and the opposite ends of the blades 78 when the oscillating shaft 74 is at either maximum traverse position. The sleeves 74*a* prevent the bags 4 and material 5 from being entrapped between the sides 10 and 11 and the blades 78, as well as being drawn around the housing drum assembly 77**.

As shown in FIGS. 6, 7 and 8, the slicer assembly 65 is preferably mounted directly in line with the input conveyor 8, such that the bags 4 and material 5 coming from the input conveyor 8 are delivered directly into the slicer assembly 65.

In operation, as seen in FIG. 6, the lower drive assembly 31 drives the common drive shaft 38 which rotates the sprocket 39 that drives the chain 58. The chain 58 is connected to the sprocket 57 mounted on the drive shaft 56 of the slitter assembly 55. As seen in FIG. 7, the drive shaft 56 in turn rotates the drum assembly 77 of the slicer assembly 65 via sprocket 59 that drives the chain 76 which is connected to the ratchet sprocket 75 mounted on the sleeve **79*a*. Therefore, the lower drive assembly 31 powers the feed conveyor 2, the input conveyor 8, the slitter assembly 55 and the slicer assembly 65**.

Referring to FIGS. 8 and 20, the oscillation of the slicer assembly 65 is created by the oscillating assembly 66 by use of the oscillator 67 connected to the ball joint assembly 73. The ball joint assembly 73 moves the oscillating shaft 74 side to side approximately one inch either side of the shaft radial center line. The oscillating shaft 74, FIG. 20, has external splines 80 at its ends that are inserted through the internally splined sleeves **79*a* and 79*b*. The ratchet sprocket 75 rotates the drum assembly 77, and in turn, the oscillating shaft 74 is rotated. The splines 80 oscillate side to side through the splined sleeves 79***a* and 79*b*. The ball joint assembly 73 allows for oscillation while the shaft 74 rotates with the drum assembly 77. The oscillation of the slicer assembly 65, in conjunction with the retarder bar 78*c*, allows the blades 78 to easily slice through the bags 4 in a horizontal plane perpendicular to the movement of the bags 4 through the housing assembly 9.

Paddle Wheels

As shown in FIGS. 6 and 7, the slitter assembly 55 and the slicer assembly 65 cooperate with a pair of paddle wheels 90 and 91 for moving the bags 4 and the material 5 within the housing assembly 9. The paddle wheel 90 assists the movement of the bags 4 and material 5 from the input conveyor 8 to the slicer assembly 65. The paddle wheel 91 assists the movement of the bags 4 and material 5 from the slitter assembly 55 to the discharge conveyor 12. The paddle wheels 90 and 91 are mounted for rotation about horizontally displaced paddle shafts 108, which are rotatably journaled in support arms 99 and 100 that are pivotally mounted to the sides 10 and 11 via torque tubes 97*a* at mount ends 101 and 102.

The torque tubes 97*a* pass through the housing assembly 9 and are rotatably journaled to sides 10 and 11. The torque tubes 97*a* connect and time the support arms 99 and 100. Paddle wheels 90 and 91 are preferably identical and are rotatably mounted at working ends 106 and 107 of the support arms 99 and 100, about the paddle shafts 108. The support arms 100 are preferably slightly longer than the support arms 99. As seen in FIG. 6, the paddle wheels 90 and 91 are rotated by drive motors 92 and gear reducer units 93, which are mounted on the side 11 close to the mounts 101 and 102. Each drive motor 92 rotates a sheave 94 that is connected to a sheave 95, which is mounted on the side 11 end of the drive shaft. 97 that is centered within the torque tube 97*a* and rotatably journaled to the support arms 99 and 100, through the belts 96. As the drive motors 92 rotate the belts 96, the drive shafts 97 are rotated in a counterclockwise direction. At the opposite extension of drive shafts 97 through first side 10, as seen in FIG. 7, a sprocket 103 is mounted thereon. The sprockets 103 are rotatably driven by shafts 97. The support arms 99 and 100 have idler sprockets 104 mounted on support blocks 105 located close to the sprockets 103. The support arms 99 and 100 have the paddle shafts 108 located close to the working ends 106 and 107. The paddle shafts 108 extend through the channels 109 located in sides 10 and 11 and are rotatably journaled through the support arms 99 and 100.

Figure 11:
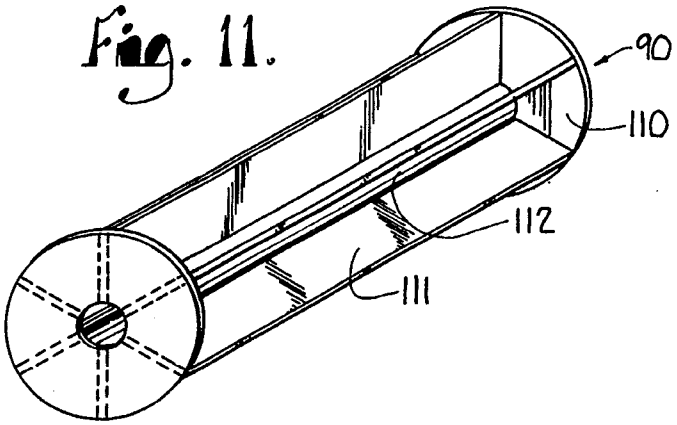
FIG. 11 is a perspective view of a first paddle wheel.

The shafts 108 have mounted sprockets 113 rotatably driven by the sprocket 103 through chains 114. As seen in FIG. 11, the paddle wheels 90 and 91 have end panels 110 that in the preferred embodiment are conical-like members. The end panels 110 are connected through a horizontally disposed center hub 112 that has six vanes 111 extending radially outward and terminate at the edge of the end panels 110. As seen in FIGS. 6 and 7, the weight of the paddle wheels 90 and 91 maintain the paddle wheels in near contact with the slicer assembly 65 and the slitter assembly 55. The idler sprockets 104 tension the chains 114. In operation, the drive motors 92, FIG. 6, turn the shafts 97 that turn the sprockets 103 and 113 counterclockwise. The rotation of the sprockets 113 causes the paddle shafts 108 to turn, thereby rotating the paddle wheels 90 and 91. The vanes 111 and center hub 112 allow the paddle wheels 90 and 91 to contain the bags 4 and material 5 within the paddle wheels 90 and 91 as they turn counterclockwise and move the bags 4 and material 5 beneath the paddle wheels 90 and 91 from the input conveyor 8 to the slitter assembly 55 and then to the discharge conveyor 12. The paddle wheel 90 has a rotational speed faster than the input conveyor 8 but slower than the rotation of speed of the slicer assembly 65 to aid in the slicing action and to prevent vaulting of the bags 4 and material 5 within the housing assembly 9. The paddle wheel 91 has a rotational speed that is faster than the first paddle wheel 90, but slower than the rotational speed of the slitter assembly 55. The slow rotational speed of the paddle wheel 91 aids in the slitting action and prevents vaulting of the bags 4 and material 5.

Bag Stripper Assembly

Figure 15:
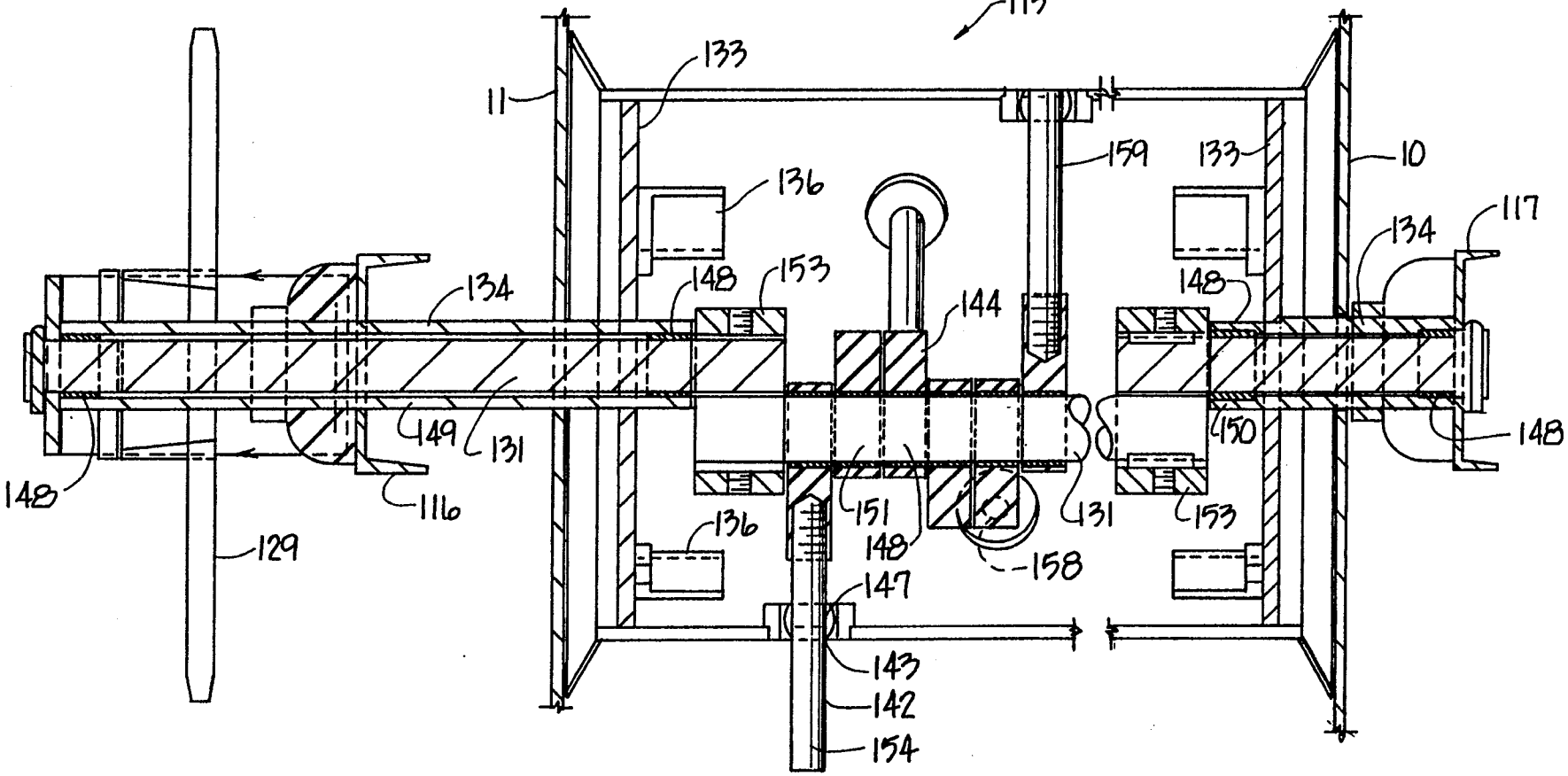
FIG. 15 is a longitudinal sectional view of the bag stripping assembly unit taken along lines 15—15 of FIG. 14.
Figure 17:
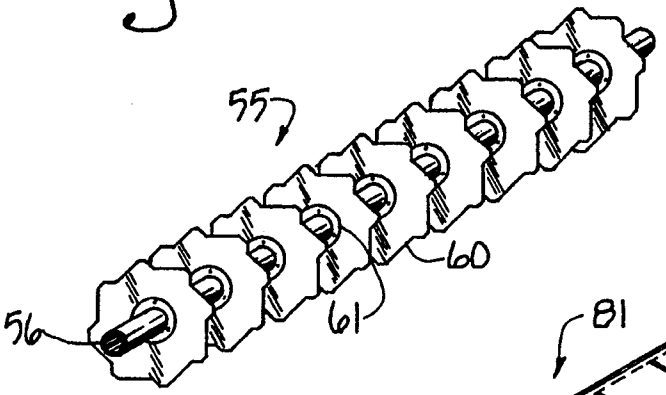
FIG. 17 is a perspective view of the slitter assembly.

As shown in FIGS. 6, 7, and 15, the bag stripper assembly 115 includes a cylindrical member which is rotatably mounted about the support arms 116 and 117. The support arms 116 and 117 are pivotally mounted to the sides 10 and 11 via torque tubes 118. The torque tubes 118 pass through the housing assembly and through sides 10 and 11. The torque tubes 118 connect and time the support arms 116 and 117 which are rotatably journaled to sides 10 and 11. Referring to FIG. 7, the shaft 119 is turned by a drive motor 121 that has a sheave 122 that rotates in a clockwise direction. The shaft 119, which is centered within the torque tubes 118 and rotatably journaled to support arms 116 and 117, which project outwardly, extends past the torque tubes 118 and has sheave 123 and a sprocket 126 mounted thereon. The sheave 123 is rotatably mounted adjacent to the first side 10 and rotated by the drive motor 121 through belts 124. The rotation of the sheave 123 causes the shaft 119 to rotate a sprocket 126 that is rotatably mounted next to the second side 11. As seen in FIG. 6, the support arm 116 has a sprocket 127 mounted on a support block 128 close to the sprocket 126 to take up slack in the chain 130. The bag stripper assembly 115 has an offset shaft 131 that does not rotate. The offset shaft 131 extends through first and second sides 10 and 11 and through the channels 132. The offset shaft 131 has extensions that project outward from the first and second sides 10 and 11 and which have rotatable sleeves 134 mounted thereon. The offset shaft 131 is mounted at a working end 135 of the support arms 116 and 117. The extension of the offset shaft 131 that projects outwardly from the second side 11 has a sprocket 129 mounted on the rotatable sleeve 134 and connected and driven by the sprocket 126 through the chain 130.

Figure 13:
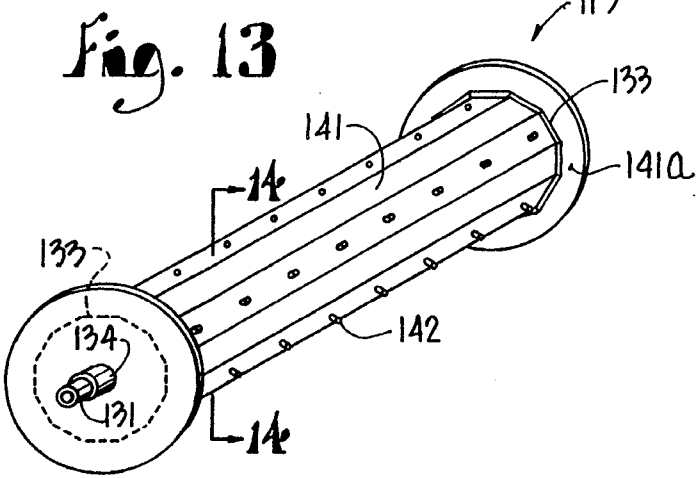
FIG. 13 is a perspective view of a bag stripping assembly.

As seen in FIGS. 13 and 15, the bag stripper assembly 115 has ends 133 welded to the sleeves 134, such that the ends 133 rotate about the offset shaft 131. The bag stripper assembly 115 includes a twelve-sided "dihexagonal" drum 141 that encloses the offset shaft 131 and bolts to the ends 133 with angle clips 136. The drum 141 also has fairings 141*a* that are welded to the edges of the drum 141. The fairings 141*a* assist in containing the bags 4 and material 5 within the bag stripping assembly 115 and prevent the same from wrapping around the sleeves 134. Referring to Figs. 6, 7 and 15, the drum 141 rotates about the offset shaft 131 when the drive motor 121 causes the shaft 119 to rotate the sprocket 126 which in turn rotates the sprocket 129.

Figure 14:
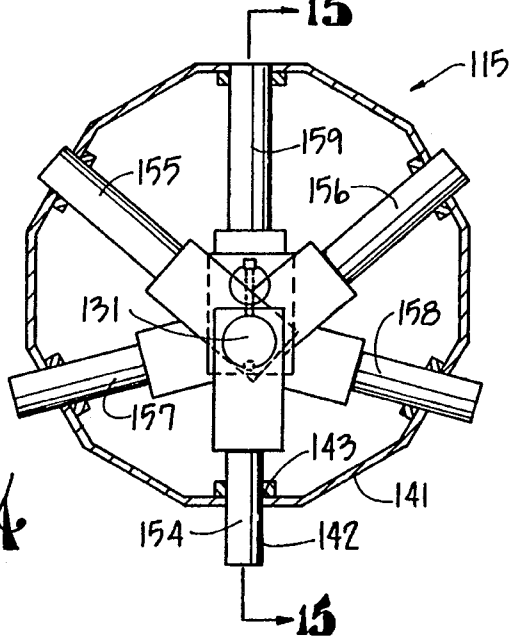
FIG. 14 is a cross sectional view of the bag stripping assembly unit taken along lines 14—14 of FIG. 13.

Referring to FIGS. 13, 14 and 15, the bag stripper assembly 115 has members 142 extending outwardly through circular shaped apertures 143 and connected to arms 144. The bag stripper assembly 115 preferably has eight groups of six arms 144 and members 142. The circular shaped apertures 143 are located on the drum 141 and are positioned approximately 60° apart. The apertures 143 have spherical bushings 147 for easy extension of the members 142.

The offset shaft 131 has rotatable bushings 148, a drive end 149, an idler end 150 and an offset center 151. The drive and idler ends 149 and 150 have the rotatable sleeves 134 mounted thereon which extends along the length of the drive and idler ends 149 and 150. The drive and idler ends 149 and 150 and the offset center 151 are mounted within the bushings 148. The drive end 149 is adjacent to the second side 11 and has the sprocket 129 mounted thereon. The idler end 150 is rotatably mounted through the support arm 116 next to the first side 10.

As seen in FIG. 15, the offset center 151 has offset blocks 153 mounted on either end of the offset center 151 and adjacent to the drive and idler ends 149 and 150. The eight groups of arms 144 and members 142 are mounted on the bushings 148 between the offset blocks 153 on the offset center 151 and aligned with the circular shaped apertures 143. As shown in FIGS. 14 and 15, the orientation of the members 142 is such that the first member 154 is positioned adjacent to the offset block 153 and extends through aperture 143 when the offset center 151 is closest to the surface of the drum 141. The next member 155 is oriented 120° away from member 154. The member 155 partially extends through the aperture 143. The next member 156 of the group is oriented 120° in a clockwise direction away from member 155 and extends through the aperture 143 as member 155. A fourth member 157 of the group is oriented 210° in a clockwise direction from the member 156 and extends through aperture 143 by a staggered amount greater than members 155 and 156 but less than the member 154. The fifth member 158 of the group is oriented 120° counterclockwise from the member 157 and extends through aperture 143 by approximately the same amount as the member 157. The sixth member 159 is oriented 120° in a counterclockwise direction from member 158 and is positioned such that the member does not extend through aperture 143. The member 159 is oriented such that the offset center 151 is furthest from the surface of the drum 141. The orientation of the remaining groups of arms 144 and members 142 proceed in the same fashion. This means the first member (not shown) of the next group is oriented 180° away from member 159 and is parallel to member 154 and extends when the offset center 151 is closest to the surface of the drum 141. The remaining members (not shown) of the next group are oriented in the same manner as the members of the first group just discussed above.

As shown in FIGS. 6, 7 and 15, the rotation of the drum 141 about the offset shaft 131 by the drive motor 121 causes the sleeves 134 and the bushings 148 to rotate. As sleeves 134 and bushings 148 rotate, the members 142 rotate concentrically with the drum 141. When the drum 141 rotates, the members 142 are extended and then retracted through apertures 143. The offset center 151 extends the members 142 when the offset center 151 is closest to the surface of the drum 141, which is when the offset center 151 and the drum 141 are closest to the discharge conveyor 12. The fully extended members 142 engage the plastic bags 4 and separate the refuse material 5 and lift the bags away from the material 5 as the bag stripper assembly 115 is rotated. When the members 142 are retracted within the apertures 143, the bags 4 are released and fall on the refuse material 5 being transported away on the discharge conveyor 12.

Discharge Conveyor

Figure 9:
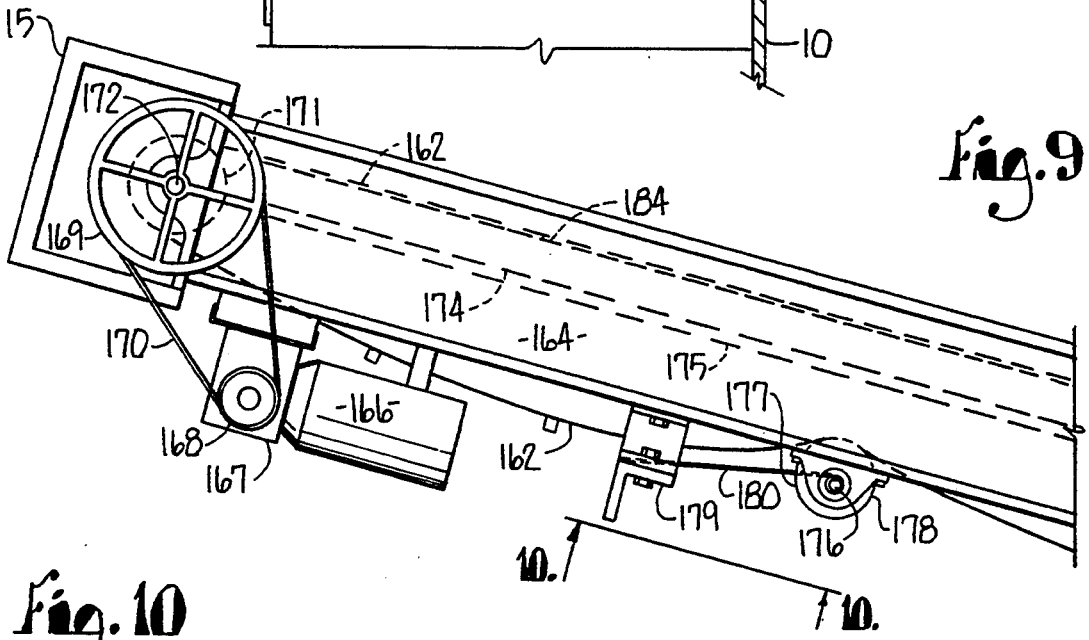
FIG. 9 is a fragmentary view of a portion of the discharge conveyor motor unit.

As seen in FIGS. 1, 2 and 3, the discharge conveyor 12 has a cleated belt conveyor surface 162 located between a first side 163 and a second side 164 of the discharge conveyor 12. The conveyor surface 162 has a center guide path 165. Referring to FIG. 9, the discharge conveyor 12 is rotatably driven by a drive motor 166 and a gear reducer 167 that has a drive sheave 168 rotating counterclockwise. The discharge conveyor 12 has a conveyor sheave 169 that is connected to the sheave 168 through belts 170. The sheave 169 is mounted adjacent to a drive roller 171 through a horizontal shaft 172 which is mounted to the sides 163 and 164. The sheave 169 is mounted on the end of the shaft 172 next to the second side 164 so that when the drive motor 166 turns the sheave 169, the shaft 172 causes the conveyor drive roller 171 to rotate.

Figure 10:
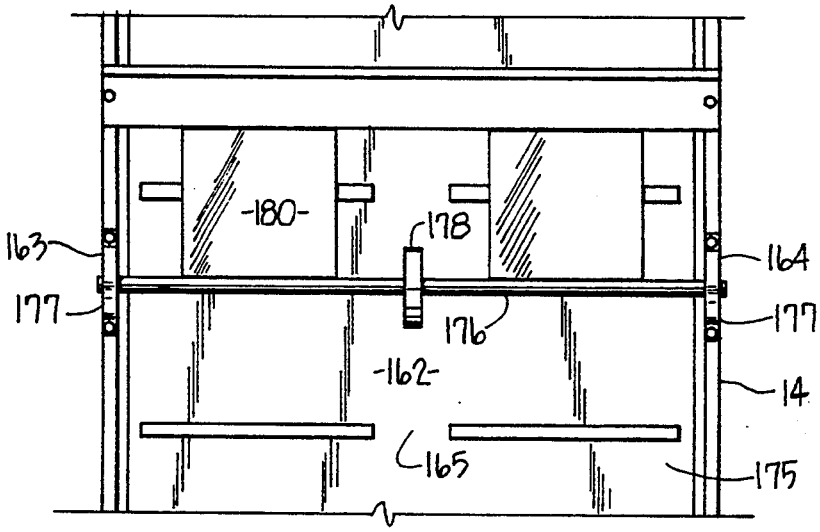
FIG. 10 is a sectional view of the discharge conveyor taken along lines 10—10 of FIG. 9.
Figure 12:
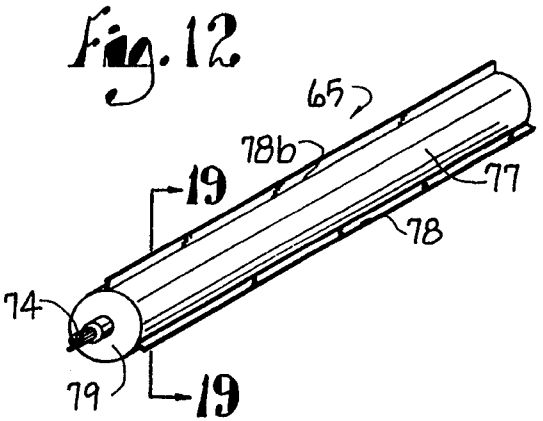
FIG. 12 is a perspective view of a slicer assembly.

The discharge conveyor 12, FIG. 9, has a top side 174 and a bottom side 175, with return roller shafts 176 mounted near the bottom side 175. As seen in FIG. 10, the return roller shafts 176 have substantially horizontally disposed rotational axis that are rotatably mounted to the sides 163 and 164 through bearing blocks 177 bolted to the sides 163 and 164. The return roller shafts 176 have center rollers 178 which ride through the center guide path 165. The discharge conveyor 12 also has frame supports 179 mounted to the bottom edges of the sides 163 and 164. The frame supports 179 have guide flaps 180 that lift the cleats above the return roller shafts 176.

As shown in FIG. 9, the discharge conveyor 12 has support rods 184 that extend the approximate length of the discharge conveyor 12 and are mounted on the top side 174. The conveyor surface 162 rides on the support rods 184 when the conveyor roller 171 is rotatably driven by the drive motor 166.

Referring to FIGS. 6 and 7, the discharge conveyor 12 is shown with a take-up roller 186 mounted underneath the housing assembly 9, and having a horizontal shaft 187 rotatably mounted in blocks 188 secured to the first and second sides 10 and 11 by bolts 189. The shaft 187 has extension ends which project outward from first and second sides 10 and 11 through a channel 190. The take-up bolts 189, when loosened, allow the conveyor roller 186 and the shaft 187 to be positioned within the channel 190. The orientation of the shaft 186 along the channel 190 allows the conveyor surface 162 to be adjusted.

Panel Doors

Referring to FIGS. 2 and 3, the housing assembly 9 has several panel doors 193 mounted on the sides 10 and 11 to allow an operator (not shown) to adjust any of the drive motor units, chain and belt drive arrangements that drive the different assemblies within the housing assembly 9. In particular, the panel door 194 is mounted on extension sides 195 and encloses the oscillating assembly 66 of the slicer assembly 65.

Summary

In operation, the plastic bag opener and removal apparatus 1 has a feed conveyor 2 for loading plastic bags 4 filled with refuse material 5. The feed conveyor 2 moves the bags 4 to an input conveyor 8 within a housing assembly 9 which then delivers the bags 4 in a generally horizontally oriented plane that follows the length of the housing assembly 9. The input conveyor 8 delivers the bags 4 to a slicer assembly 65 including an oscillating assembly 66 and blades 78 for slicing the bags 4 horizontally and perpendicular to the movement of the input conveyor 8. As the slicer assembly 65 is slitting the bags 4, a first paddle wheel 90 which is directly above the slicer assembly 65, rotates and holds the bags 4 against the slicing assembly 65. The first paddle wheel 90 then assists in moving the refuse material 5 and the bags 4 to the slitter assembly 55, which has slitter disks 60 with sharpened notches for slicing the bags 4 open generally horizontally and parallel to the delivery of the bags 4 by the input conveyor 8. A second paddle wheel 91 is positioned directly above and slightly behind the slitter assembly 55 and keeps the material 5 and plastic bags 4 beneath the paddle wheel 91 and against the slitter assembly 55. The second paddle wheel 91 then assists in moving the bags 4 and material 5 to the discharge conveyor 12 and delivers the open bags 4 to an awaiting bag stripper assembly 115. The bag stripper assembly 115 has extending members 142 along a twelve-sided drum surface 141 that are extended when the drum surface 141 is adjacent to the discharge conveyor surface 162. The members 142 are retracted within the drum 141 as the bag stripper assembly 115 rotates about its offset shaft 131. As the members 142 are extended, the members 142 make contact with and pick the bags 4 off from the material 5. As the bag stripper assembly 115 rotates, the members extend and retract relative to the drum 141, which allows the bags 4 to freely fall on top of the material 5 as the discharge conveyor 12 moves the material 5 out of the housing assembly 9.

As the refuse material 5 and bags 4 are carried out by the discharge conveyor 12, an operator can remove the bags 4 without disturbing the refuse material 5. The operator (not shown) can be standing on the frame 14 that supports the discharge conveyor 12. The discharge conveyor 12 has an approximate 15° incline which carries the remaining material 5 to the chute end 15 of the support frame 14 and allows the discharge conveyor 12 to dump the material 5 through a drop guide 16 into an awaiting transport vehicle.

The feed conveyor 2 and the input conveyor 8 are driven by the lower drive assembly 31. The lower drive assembly 31 also rotatably drives the slitter assembly 55 and the slicer assembly 65. The oscillating assembly 66 of the slicer assembly 65 is connected to its own oscillating drive motor 72 through a ball joint assembly 73. The first and second paddle wheels 90 and 91 are each rotatably driven by drive motors 92. The bag stripper assembly 115 is rotatably driven by a drive motor 121. The discharge conveyor 12 is rotatably driven by a drive motor 166.

It is to be understood that while certain forms of this invention have been illustrated and described, the invention is not limited thereto, except insofar as such limitations are included in the following claims.

What is claimed and desired to be secured by Letters Patent is as follows:

1. An apparatus for removing bags, which comprises:

a) a substantially enclosed housing having:

i) a receiving end and a discharge end;

ii) a slicing zone adjacent to said enclosed housing receiving end having means for slicing bags filled with material;

iii) a slitting zone proximate to said slicing zone having means for slitting said bags;

iv) a bag stripping zone between said slitting zone and said enclosed housing discharge end having means for stripping said bags from said material and placing said bags on top of said material for removal thereof;

v) an input conveyor means for moving said bags and said material in a plane generally horizontal between said enclosed housing receiving end and said slicing zone, said input conveyor having means for driving said input conveyor means;

vi) first and second paddle wheels for propelling and containing said bags and said material within said enclosed housing, said first and second paddle wheels having paddle wheel rotatable shafts mounted substantially horizontally within said enclosed housing and means for rotatably driving said paddle wheel shafts, said first paddle wheel moving said bags and said material from said input conveyor to said slicing zone, said second paddle wheel moving said bags and said material from said slitting zone to a discharge conveyor and said bag stripping zone;

b) a feed conveyor means for feeding said enclosed housing receiving end with said bags filled with said material, said feed conveyor means having connection means with said input conveyor means for driving said feed conveyor means;

c) said discharge conveyor means for removing said bags and said material from said enclosed housing and having first and second ends, said first discharge conveyor end being disposed in said enclosed housing, said discharge conveyor extending out of and away from said enclosed housing discharge end with said second discharge conveyor end being remote from said enclosed housing, said discharge conveyor means having means for driving said discharge conveyor means; and d) a frame for supporting said feed and discharge conveyors means, said frame affixed to said enclosed housing and including a support generally between said enclosed housing discharge end and said second discharge conveyor end for removal of said bags from said material travelling along said discharge conveyor.

2. The apparatus as claimed in claim 1, wherein said slicing means includes:

a) a generally cylindrical first drum mounted on a rotatable first shaft mounted substantially horizontally within said enclosed housing, said cylindrical first drum having at least one blade having opposite ends and extending radially outward, said blade slicing said bags along a plane generally transverse to said movement of said bags within said enclosed housing;

b) means for rotation of said first shaft; and c) said cylindrical first drum having sleeves mounted over said opposite ends of said blade.

3. The apparatus as claimed in claim 2, wherein said slicing means includes means for oscillating said first shaft.

4. The apparatus as claimed in claim 1, wherein said slitting means includes:

a) a rotatable second shaft mounted substantially horizontally within said enclosed housing, said second shaft having at least one disk with cutting edges and extending radially outward, said disk slitting said bags along a plane generally horizontal and parallel to said movement of said bags within said enclosed housing; and b) means for rotation of said second shaft.

5. The apparatus as claimed in claim 1, wherein said bag stripping means comprises:

a) a plurality of support arms having a driving end and a support end, said driving end having means for rotating a generally cylindrical second drum;

b) a third shaft affixed to said support end of said support arms along a generally horizontal plane and extending through said cylindrical second drum, said third shaft having first and second third shaft ends and an offset center having a plurality of support blocks mounted for rotation about said offset center, said third shaft having generally cylindrical members for rotation about said third shaft ends, said first third shaft end having connection means with said means for rotating said cylindrical second drum;

c) said cylindrical second drum comprising:

i) second drum opposite end plates mounted on said cylindrical members for rotation about said third shaft; and ii) a generally cylindrical surface affixed to said second drum opposite end plates, said surface having a plurality of spherical shaped apertures such that when said cylindrical second drum rotates about said third shaft, said cylindrical surface will have first and second sides, said first side having said apertures adjacent to said offset center, said second side having said apertures spaced apart from said offset center; and d) a plurality of extended members mounted on said support blocks for rotation about said offset center and protrusion through said apertures, said members protruding radially outward from said cylindrical surface when said offset center is adjacent to said first side of said cylindrical surface and stripping said bag from said material, said members placing said stripped bag on top of said material for removal thereof.

6. An apparatus for removing bags, which comprises:

a) a substantially enclosed housing having:

i) a receiving end and a discharge end;

ii) a slicing zone adjacent to said enclosed housing receiving end for slicing bags filled with material, said slicing zone comprising:

(1) a generally cylindrical first drum mounted on a rotatable first shaft mounted substantially horizontally within said enclosed housing, said cylindrical first drum having at least one blade having opposite ends and extending radially outward, said blade slicing said bags along a plane generally transverse to said movement of said bags within said enclosed housing;

(2) said first shaft having first and second ends, said first end of said first shaft having connections with a driving motor for rotating and oscillating said first shaft, said oscillations providing for improved slicing of said bags; and (3) said cylindrical first drum having sleeves mounted over said opposite ends of said blade;

iii) a slitting zone proximate to said slicing zone for slitting said bags, said slitting zone comprising:

(1) a rotatable second shaft mounted substantially horizontally within said enclosed housing, said second shaft having at least one disk with cutting edges and extending radially outward, said disk slitting said bags along a plane generally horizontal and parallel to said movement of said bags within said enclosed housing; and (2) said second shaft having connections with a driving motor for rotating said second shaft;

iv) a bag stripping zone between said slitting zone and said enclosed housing discharge end for stripping said bags from said material and placing said bags on top of said material for removal thereof, said bag stripping zone comprising:

(1) a plurality of support arms having a driving end and a support end, said driving end having means for rotating a generally cylindrical second drum;

(2) a third shaft affixed to said support end of said support arms along a substantially horizontal plane and extending through said cylindrical second drum, said third shaft having first and second third shaft ends and an offset center having a plurality of support blocks mounted for rotation about said offset center, said third shaft having generally cylindrical members mounted on said third shaft ends, said cylindrical members having rotational means, said first third shaft end having connections with said means for rotating said cylindrical second drum;

(3) said cylindrical second drum comprising:

(a) first and second sidewalls mounted on said cylindrical members for rotation about said third shaft; and (b) a generally cylindrical surface affixed to said first and second sidewalls, said surface having a plurality of spherical shaped apertures such that when said cylindrical second drum rotates about said offset center, said cylindrical surface will have first and second sides, said first side having said apertures adjacent to said offset center, said second side having said apertures spaced apart from said offset center; and (4) a plurality of extended members mounted on said support blocks for rotation about said offset center and protrusion through said apertures, said members protruding radially outward from said cylindrical surface when said offset center is adjacent to said first side of said cylindrical surface and stripping said bag from said material, said members placing said stripped bag on top of said material for removal thereof;

v) an input conveyor for moving said bags and said material in a plane generally horizontal between said enclosed housing receiving end and said slicing zone, said input conveyor having connections with a driving motor for driving said input conveyor; and vi) first and second paddle wheels for propelling and containing said bags and said material within said enclosed housing, said first and second paddle wheels having paddle wheel rotatable shafts mounted substantially horizontally within said enclosed housing and connections with driving motors for rotation of said paddle wheel rotatable shafts, said first paddle wheel moving said bags and said material from said input conveyor to said slicing zone, said second paddle wheel moving said bags and said material from said slitting zone to a discharge conveyor and said bag stripping zone;

b) a feed conveyor for feeding said enclosed housing receiving end with said bags filled with said material, said feed conveyor having connections with said driving motor of said input conveyor for moving said feed conveyor;

c) said discharge conveyor for removing said bags and said material from said enclosed housing and having first and second ends, said first discharge conveyor end being disposed in said enclosed housing, said discharge conveyor extending out of and away from said enclosed housing discharge end with said second discharge conveyor end being remote from said enclosed housing, said discharge conveyor having connections with a driving motor for moving said discharge conveyor; and d) a frame for supporting said feed and discharge conveyors, said frame affixed to said enclosed housing and including a support generally between said enclosed housing discharge end and said second discharge conveyor end for removal of said bags from said material travelling along said discharge conveyor.

7. An apparatus for removing bags, which comprises:

a) a substantially enclosed housing having:

i) a receiving end and a discharge end;

ii) a slicing zone adjacent to said enclosed housing receiving end having means for slicing bags filled with material, said means comprising:

(1) a generally cylindrical first drum mounted on a rotatable first shaft mounted substantially horizontally within said enclosed housing, said cylindrical first drum having at least one blade having opposite ends and extending radially outward, said blade slicing said bags along a plane generally transverse to said movement of said bags within said enclosed housing;

(2) means for rotating said first shaft;

(3) means for oscillating said first shaft for improved slicing of said bags; and (4) said cylindrical first drum having sleeves mounted over said opposite ends of said blade;

iii) a slitting zone proximate to said slicing zone having means for slitting said bags, said means comprising:

(1) a rotatable second shaft mounted substantially horizontally within said enclosed housing, said second shaft having at least one disk with cutting edges and extending radially outward, said disk slitting said bags along a plane generally horizontal and parallel to said movement of said bags within said enclosed housing; and (2) means for rotating said second shaft;

iv) a bag stripping zone between said slitting zone and said enclosed housing discharge end having means for stripping said bags from said material and placing said bags on top of said material for removal thereof, said means comprising:

(1) a plurality of support arms having a driving end and a support end, said driving end having means for rotating a generally cylindrical second drum;

(2) a third shaft affixed to said support end of said support arms along a generally horizontal plane and extending through said cylindrical second drum, said third shaft having first and second third shaft ends, and an offset center having a plurality of support blocks mounted for rotation about said offset center, said third shaft having generally cylindrical members mounted on said third shaft ends, said cylindrical members having rotational means, said first third shaft end having connection means with said means for rotating said cylindrical second drum;

(3) said cylindrical second drum comprising:

(a) first and second sidewalls mounted on said cylindrical members for rotation about said third shaft; and (b) a generally cylindrical surface affixed to said rotational first and second sidewalls, said surface having a plurality of spherical shaped apertures such that when said cylindrical second drum rotates about said offset center, said cylindrical surface will have first and second sides, said first side having said apertures adjacent to said offset center, said second side having said apertures spaced apart from said offset center;

(4) a plurality of extended members mounted on said support blocks for rotation about said offset center and protrusion through said apertures, said members protruding radially outward from said cylindrical surface when said offset center is adjacent to said first side of said cylindrical surface and stripping said bag from said material, said members placing said stripped bag on top of said material for removal thereof;

v) an input conveyor means for moving said bags and said material in a plane generally horizontal between said enclosed housing receiving end and said slicing zone, said input conveyor having means for driving said input conveyor means;

vi) first and second paddle wheels for propelling and containing said bags and said material within said enclosed housing, said first and second paddle wheels having paddle wheel rotatable shafts mounted substantially horizontally within said enclosed housing and means for rotation of said paddle wheel rotatable shafts, said first paddle wheel moving said bags and said material from said input conveyor to said slicing zone, said second paddle wheel moving said bags and said material from said slitting zone to a discharge conveyor and said bag stripping zone;

b) a feed conveyor means for feeding said enclosed housing receiving end with said bags filled with said material, said feed conveyor means having connection means with said input conveyor means for driving said feed conveyor means;

c) said discharge conveyor means for removing said bags and said material from said enclosed housing and having first and second ends, said first discharge conveyor end being disposed in said enclosed housing, said discharge conveyor extending out of and away from said enclosed housing discharge end with said second discharge conveyor end being remote from said enclosed housing, said discharge conveyor means having means for driving said discharge conveyor means; and d) a frame for supporting said feed and discharge conveyors means, said frame affixed to said enclosed housing, said frame including a support generally between said enclosed housing discharge end and said second discharge conveyor end for removal of said bags from said material travelling along said discharge conveyor.

8. An apparatus for removing bags, which comprises:

a) a substantially enclosed housing comprising:

i) a receiving end and a discharge end;

ii) a slicing zone adjacent to said enclosed housing receiving end having means for slicing bags filled with material;

iii) a slitting zone proximate to said slicing zone having means for slitting said bags; and iv) a bag stripping zone between said slitting zone and said enclosed housing discharge end having means for stripping said bags from said material and placing said bags on top of said material for removal thereof, said means comprising:

(1) a plurality of support arms having a driving end and a support end, said driving end having means for rotating a generally cylindrical drum;

(2) a shaft affixed to said support end of said support arms along a generally horizontal plane and extending through said cylindrical drum, said shaft having first and second ends, and an offset center having a plurality of support blocks mounted for rotation about said offset center, said shaft having generally cylindrical members mounted on said first and second ends, said cylindrical members having rotational means, said first end having connection means with said means for rotating said cylindrical drum;

(3) said cylindrical drum comprising:

(a) first and second sidewalls mounted on said cylindrical members for rotation about said shaft; and (b) a generally cylindrical surface affixed to said rotational first and second sidewalls, said surface having a plurality of spherical shaped apertures such that when said cylindrical housing rotates about said offset center said cylindrical surface will have first and second sides, said first side having said apertures adjacent to said offset center, said second side having said apertures spaced apart from said offset center;

(4) a plurality of extended members mounted on said support blocks for rotation about, said offset center and protrusion through said apertures, said members protruding radially outward from said cylindrical surface when said offset center is adjacent to said first side of said cylindrical surface and stripping said bag from said material, said members placing said stripped bag on top of said material for removal thereof;

b) a feed conveyor means for feeding said enclosed housing receiving end with said bags filled with said material;

c) a discharge conveyor means for removing said bags and said material from said enclosed housing;

d) means for driving said feed and discharge conveyors; and e) a frame affixed to said enclosed housing for supporting said feed and discharge conveyors.

9. An apparatus for removing bags, which comprises:

a) a substantially enclosed housing comprising:

i) a receiving end and a discharge end;

ii) a slicing zone adjacent to said enclosed housing receiving end having means for slicing bags filled with material;

iii) a slitting zone proximate to said slicing zone having means for slitting said bags;

iv) a bag stripping zone between said slitting zone and said enclosed housing discharge end having means for stripping said bags from said material and placing said bags on top of said material for removal thereof;

v) an input conveyor means for moving said bags and said material in a plane generally horizontal between said enclosed housing receiving end and said slicing zone; and vi) first and second rotational control means for propelling and containing said bags and said material within said enclosed housing, said first rotational control means including a first shaft mounted rotating wheel for moving said bags and said material from said input conveyor means to said slicing zone, said second rotational control means including a second shaft mounted rotating wheel for moving said bags and said material from said slitting zone to a discharge conveyor and said bag stripping zone;

b) a feed conveyor means for feeding said enclosed housing receiving end with said bags filled with said material, said feed conveyor means having connection means with said input conveyor for driving said feed conveyor;

c) said discharge conveyor having means for removing said bags and said material from said enclosed housing and having first and second ends, and means for driving said discharge conveyor means, said first discharge conveyor end being disposed in said enclosed housing, said discharge conveyor extending out of and away from said enclosed housing discharge end with said second discharge conveyor end being remote from said enclosed housing; and d) a frame affixed to said enclosed housing for supporting said feed and discharge conveyors.

10. The apparatus as claimed in claim 9, wherein said slicing means includes:

a) a generally cylindrical drum mounted on a rotatable first shaft mounted substantially horizontally within said enclosed housing, said cylindrical drum having at least one blade having opposite ends and extending radially outward, said blade slicing said bags along a plane generally transverse to said movement of said bags within said enclosed housing;

b) means for rotation of said first shaft; and c) said cylindrical first drum having sleeves mounted over said opposite ends of said blade.

11. The apparatus as claimed in claim 9, wherein said bag stripping means includes:

a) a plurality of support arms having a driving end and a support end, said driving end having means for rotating a generally cylindrical second drum;

b) a second shaft affixed to said support end of said support arms along a generally horizontal plane and extending through said cylindrical second drum, said second shaft having an offset center having a plurality of support blocks mounted for rotation thereon, said cylindrical second drum having a surface having spherical shaped apertures; and c) a plurality of extended members mounted on said support blocks mounted for rotation about said offset center and protrusion through said apertures, said members protruding through said apertures when said surface rotates proximate to said offset center and stripping said bags from said material, said members placing said bags on top of said material for removal thereof, said members retracting within said apertures when said surface rotates distant from said offset center.

* * * * *

UNITED STATES PATENT AND TRADEMARK OFFICE

CERTIFICATE OF CORRECTION

PATENT NO. : 5,368,431

DATED : November 29, 1994

INVENTOR(S) : Edward B. Willey et al.

It is certified that error appears in the above-indentified patent and that said Letters Patent is hereby corrected as shown below:

Column 6, line 8, instead of "bar", it should be --bars--.

In the drawings, Sheet 4, Fig. 6, should be as follows:

Fig. 6

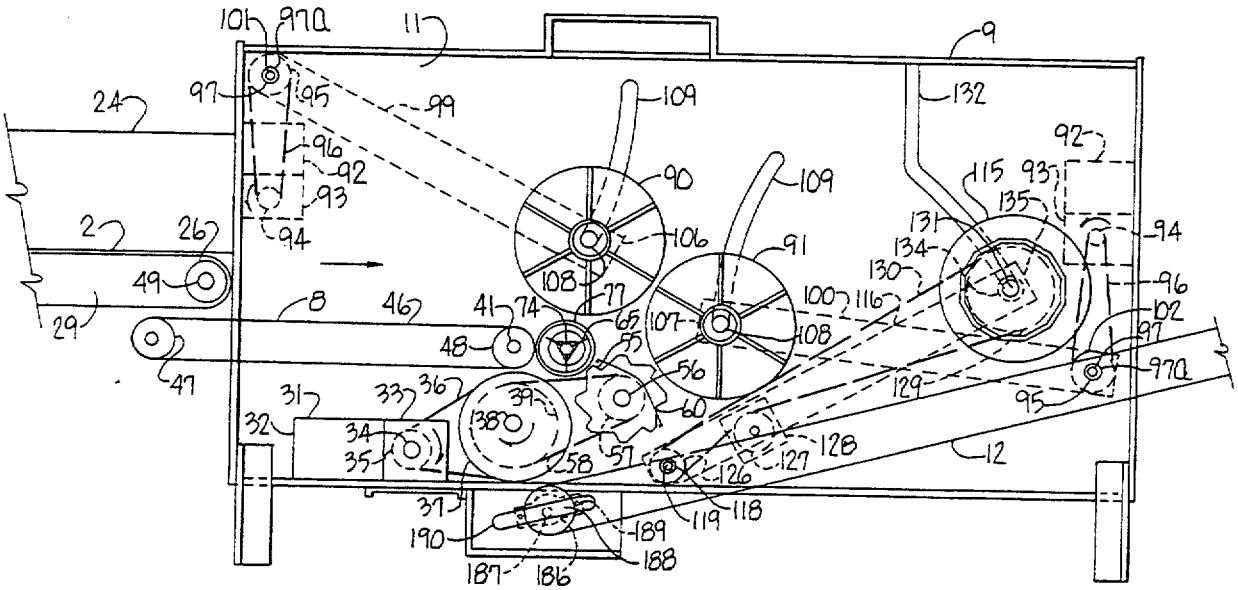

UNITED STATES PATENT AND TRADEMARK OFFICE

CERTIFICATE OF CORRECTION

PATENT NO. : 5,368,431

DATED : November 29, 1994

INVENTOR(S) : Edward B. Willey et al.

It is certified that error appears in the above-indentified patent and that said Letters Patent is hereby corrected as shown below:

In the drawings, Sheet 5, Fig. 7, should be as follows:

Fig. 7

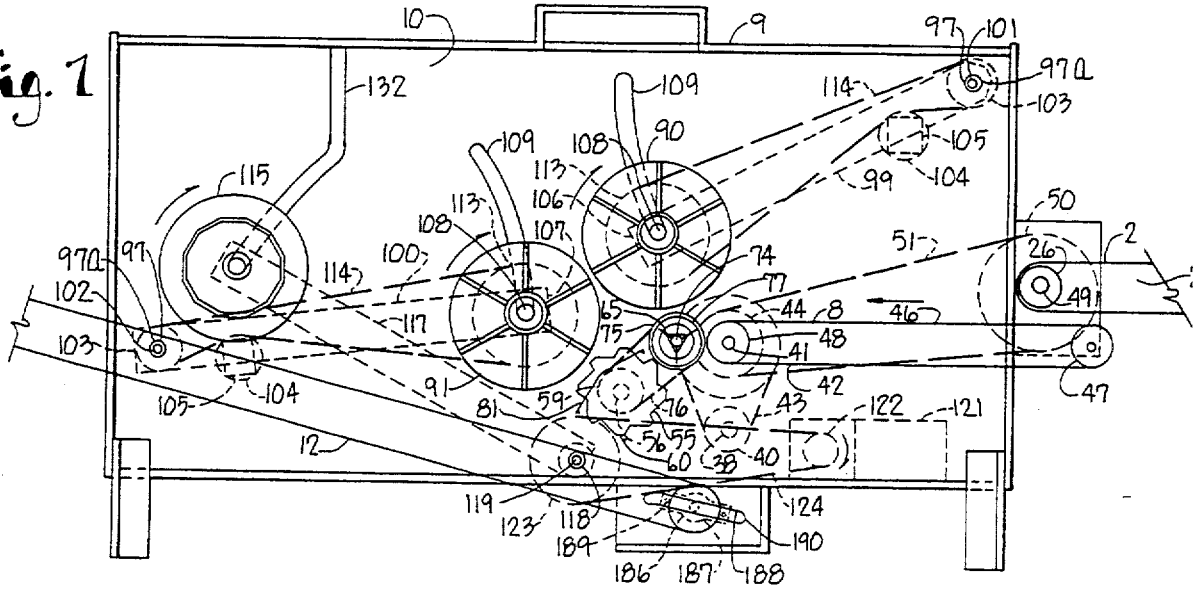

Signed and Sealed this

First Day of August, 1995

Bruce Lehman

*Attest:*

BRUCE LEHMAN

*Attesting Officer*

*Commissioner of Patents and Trademarks*